United States Patent [19]

Shreve

[11] Patent Number: 4,824,018

[45] Date of Patent: Apr. 25, 1989

[54] QUICK CHANGE SPRAY PAINT RECEPTACLE APPARATUS

[76] Inventor: Donald R. Shreve, 2712 Feasler St., Erie, Pa. 16506

[21] Appl. No.: 123,765

[22] Filed: Nov. 23, 1987

[51] Int. Cl.[4] ..... B05B 15/02; A47L 25/00

[52] U.S. Cl. ..... 239/114; 239/123; 15/210 B; 220/90

[58] Field of Search ..... 239/DIG. 14, 302, 340, 239/366, 368, 369, 375, 310, 318, 114, 104, 123, 120; 222/325, 148; 220/90, 229; 15/210 B

[56] References Cited

U.S. PATENT DOCUMENTS

| | | | |
|---|---|---|---|
| 2,051,518 | 8/1936 | Cunningham | 239/302 |
| 2,263,845 | 11/1941 | Hartsell | 15/210 B |
| 2,627,619 | 2/1953 | Gagen | 220/90 |
| 3,061,862 | 11/1962 | Minor | 15/210 B |
| 3,822,753 | 7/1974 | Tate | 15/210 B |
| 3,913,785 | 10/1975 | Pattershall | 220/90 |
| 3,938,686 | 2/1976 | Milligan et al. | 220/90 |
| 4,017,935 | 4/1977 | Hernandez | 15/210 B |
| 4,405,088 | 9/1983 | Gray | 239/302 |

*Primary Examiner*—Andres Kashnikow
*Assistant Examiner*—Karen B. Merritt
*Attorney, Agent, or Firm*—Charles L. Lovercheck; Wayne L. Lovercheck; Dale R. Lovercheck

[57] ABSTRACT

A paint receptacle apparatus comprising an open topped can having a first outwardly and downwardly directed flange attached to its open upper end and a lid having a second downwardly and inwardly extending flange engaging the first flange. The cover has a tube receiving opening having a cylindrical tube wiper received in it. The wiper has a cylindrical body received in the opening and an outwardly directed flange attached to its upper end overlying the lid and a first inwardly directed wiper flange and a second inwardly directed wiper flange receiving the tube of a paint gun. The wiper flanges each have a vent opening and a divider holding them apart. The flanges wipe the paint from the tube when the tube is removed from the can.

6 Claims, 2 Drawing Sheets

QUICK CHANGE SPRAY PAINT RECEPTACLE APPARATUS

BACKGROUND OF THE INVENTION

This invention relates to paint spraying apparatus and more particularly to paint receptacles in which individual paint colors can be stored and readily used.

GENERAL DESCRIPTION OF THE INVENTION

The paint receptacle apparatus disclosed herein is made up of four pieces: (1) the receptacle, (2) the lid, (3) the wiper and (4) the plug. The receptacle is for holding the liquid and has a flange around the outer perimeter which cooperates with the flange and provides a seal. A vent hole is provided in the lid to allow air to replace the liquid as it is used. A fluid tube hole is provided for the spray gun interface to enter. The fluid tube hole provides a means for inserting the tube and removing the liquid. The wiper at the fluid tube hole removes the liquid on the outside of the tube during withdrawal of the tube from the lid. A plug, or plugs, is provided to close the fluid tube hole and the vent hole in the lid when the assembly is not in use. As an alternate, the two holes can be combined as in FIG. 5. Thus the gun can be moved from one can to another.

GENERAL STATEMENT OF THE INVENTION

The paint receptacle apparatus disclosed herein can be made to fit a variety of spray paint equipment manufacturered by different manufacturers. The paint receptacle apparatus can be hand held, keeping it simple and easy for cleaning. The paint receptacle could be suspended from a spray gun or even the fluid tube by attaching it to a bracket. The paint receptacle could be provided with a fluid tube simpler than now available and different types of tubes could be provided to fit each particular gun manufacturers' equipment. The lid can be provided with baffles to prevent the liquid in the receptacle from splashing out of the vent holes. In addition, this will make cleanup less difficult. The improved features of the paint receptacle apparatus disclosed herein are: (1) The lid is separate and easily removable from the receptacle. The lid is not mounted to the fluid tube of the spray gun; (2) the receptacle may be one of a full line of receptacles for colors and sizes; (3) the lid may have the vent hole and wiper for wiping the fluid tube; (4) the lid may be provided with a release feature to compensate for the force required to seal the lid; (5) the receptacle and lid assembly may be hung from the fluid tube.

The present paint receptacle apparatus can be applied to lacquer, primers, various colors for small jobs for different colors of automobiles or the like. Gun cleaning solvent to flush clean inside the tube and spray gun between uses can be used. The apparatus disclosed can be used for flexible paints, for rubber paints, primers, color coats, and clear coats, these parts are painted separately from the rest of an automobile generally.

An additional feature which may be used is a dust cover. A baffle vented wiper is provided. A wiper is provided for the fluid tube which removes paint from the tube. Additional novel features include a lid sealing structure to compensate for size variations of the cap using the same seal part as the can.

Other additional features include a perimeter sealing method that allows for size changes of caps. This will reduce the number of cap rejects and also compensate for expansion and contraction and swelling of the materials used. The seal also provides two-point sealing, thus reducing the possible leaks from dried paint in seals.

Additional features disclosed include the receptacle to fluid tube holder having leaf spring with pockets on each side to contain the lid and a ring portion of the receptacle apparatus. This spring action could be stopped during spraying by a stiffening bar. The stiffening bar would lock the cap assembly in place. A detent should be provided to keep the bar from rotating without the operator forcing it. The leaf spring assembly must also be wide enough to prevent the cup from rotating out of position and falling off. The off center positions of the fluid tube holder will make the receptacle be put on in one direction only.

REFERENCE TO PRIOR ART

Previous attempts at solving the problem solved by the invention herein have been made by providing a plastic liner for use with the existing cup on the gun. Examples of such a liner is shown in U.S. Pat. No. 2,622,770 to Penno, U.S. Pat. No. 3,401,842 to Morrison, U.S. Pat. No. 4,151,929 to Sapien and U.S. Pat. No. 4,307,820 to Binoche. The liner was meant to be disposable, keeping the cup clean. To make the liner work, the liner has to be held in position while the paint or liquid is put in it. This required a two-piece holding ring, one at the inside of the liner. The other ring would be used to turn the excess material of the bag down out of the way for filling. The problem with this method is that it leaves the majority of the hard cleaning of excess paint still to be done. Another problem is the time consuming and not time saving. Finally it provides no storing ability for mixed, ready-to-use paints or liquids.

Another problem exists in fitting covers or lids to paint cans. Examples are found in U.S. Pat. No. 3,642,167 to Kinney and U.S. Pat. No. 3,085,994 to Cherry et al.

A specific can lid is disclosed which is an improvement over the above U.S. Patents.

OBJECTS OF THE INVENTION

It is an object of the invention to provide an improved paint receptacle apparatus.

Another object of the invention is to provide a spray painting apparatus for various kinds of paint ready to use.

Another object of the invention is to provide a spray painting apparatus that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in form, size, proportions and minor details of construction without departing from the spirit or sacrificing any of the advantages of the invention.

DETAILED DESCRIPTION OF THE DRAWING

Figure 1:
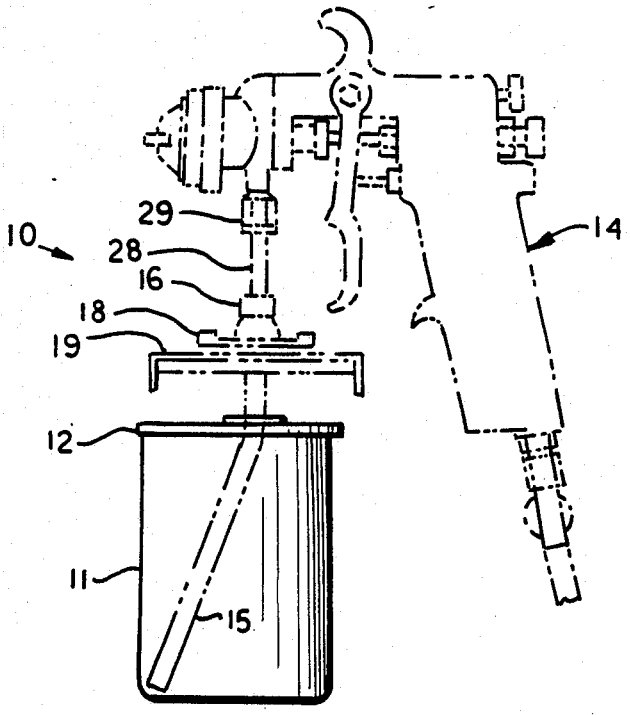
FIG. 1 is a side view of the paint receptacle apparatus according to the invention showing a conventional spray gun used with it in phantom.
Figure 2:
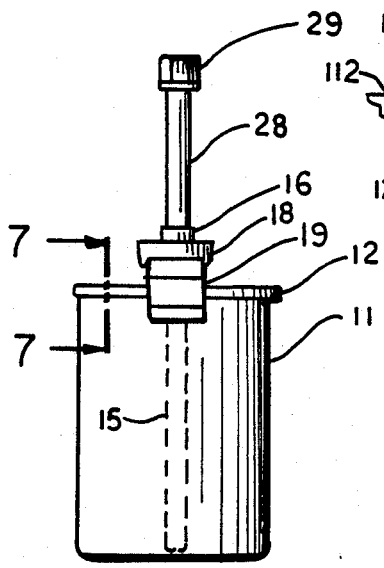
FIG. 2 is a side view of the apparatus shown in FIG. 1 with the paint gun removed and said fluid tube according to the invention.
Figure 10:
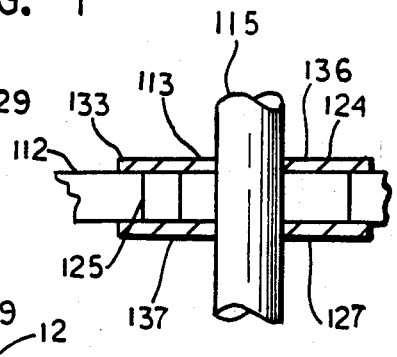
FIG. 10 is a cross sectional view taken on line 10—10 of FIG. 5.
Figure 6:
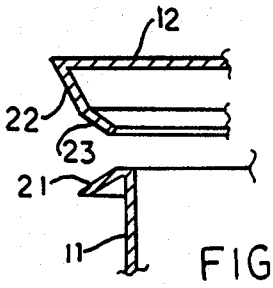
FIG. 6 is an enlarged partial cross sectional view similar to FIG. 7 with the lid removed from the can according to the invention.
Figure 7:
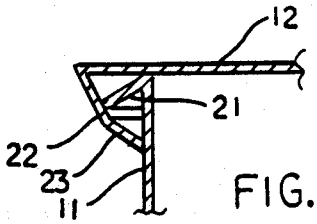
FIG. 7 is a partial cross sectional view taken on line 7—7 of FIG. 2.
Figure 8:
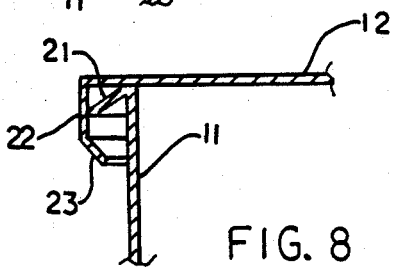
FIG. 8 is a partial cross sectional view similar to FIG. 7 of a slightly different dimensional fit between the lid and the can.
Figure 3:
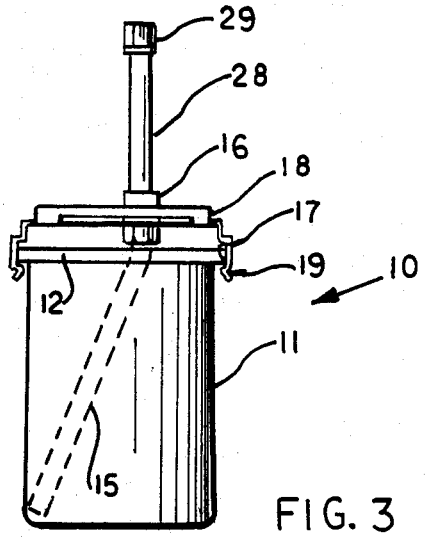
FIG. 3 is a front view of the apparatus shown in FIG. 2.

Now with more particular reference to the drawings, a combination paint can and lid 10 is shown which comprises the paint can 11 which is generally cylindrical in shape with an open top and a closed bottom and a lid 12. An outwardly and downwardly extending first flange 21 is fixed to the outer periphery of the upper end of can 11. First flange 21 is integrally attached to can 11 and extends outwardly and downwardly therefrom at an acture angle to the horizontal. Lid 12 has an inwardly and downwardly extending second flange part 22, integrally fixed to it, terminating in an annular third flange part 23 which is integrally attached to second flange 22, extending inwardly at a greater angle to the vertical than said first flange part 21. The first flange part 21 has an outer edge engaging second flange part 22 and forms a seal with it. The lid 12 has a fluid tube opening 13 which receives a fluid tube 15. The spray gun 14 is of the type familiar to those skilled in the art. The spray gun 14 is attached to the tube part 28 by nut 29. The tube 15 extends through an opening in the cover 12 and through a hole through the leaf spring bracket 19 by means of lock nut 16 in a manner familiar to those skilled in the art. Tube part 28 is fixed to tube 15 by lock nut 16. In FIG. 3, spring bracket lock 18 is shown rotated 90 degrees from the position shown in FIG. 2. The leaf spring bracket 19 will flex allowing the paint can 11 to enter the recess 17 provided in leaf spring bracket 19. Then rotating the spring bracket lock 18 back 90 degrees will confine the leaf spring bracket 19 in a manner familiar to those skilled in the art. Detents on spring bracket lock 18 will hold the tube 15 in the proper position.

Figure 4:
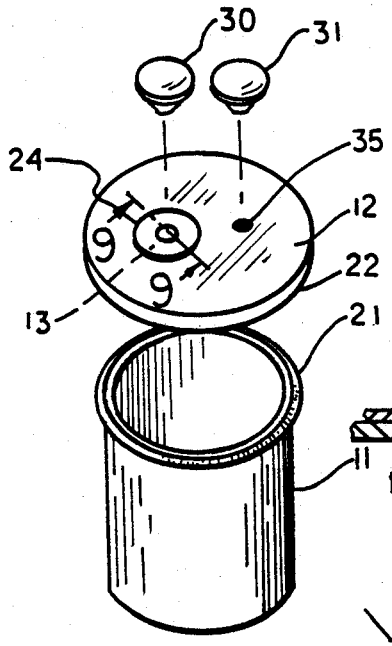
FIG. 4 is an exploded view of the can and lid.
Figure 9:
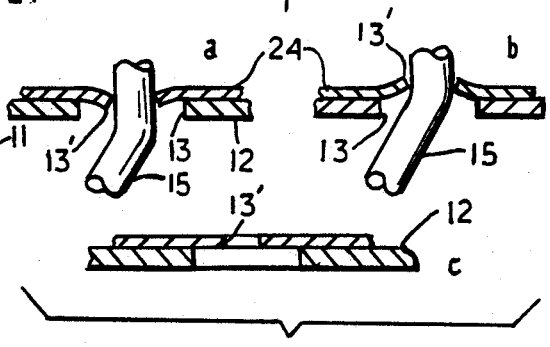
FIG. 9 is a series of partial cross sectional views taken on line 9—9 of FIG. 4.

FIG. 4 shows the paint can 11 having an annular flange 21 for attaching and sealing to the lid 12. Lid 12 has a vent hole 35, which provides a vent for the can. Wiper assembly 24 may be made of a resilient material such as rubber, neoprene, or other suitable material supported on lid 12 in fluid tube opening 13 in the lid. Opening 13' is formed in the wiper assembly and has a smaller diameter than tube 15 so that when tube 15 is forced through opening 13', of the wiper assembly 24, the material defining the opening is deflected. When opening 13' is stretched to accommodate tube 15 and the material surrounding the opening 13' is forced to take the position shown in FIG. 9*a*. The downwardly distorted opening 13' periphery forms a wiping surface, for wiping the tube 15 when the tube 15 is removed as shown in FIG. 9*b*. The material around the opening 13' is moved to the position shown in FIG. 9*b*. FIG. 9*c* shows the wiper 24 with tube 15 removed from opening 13'. When not in use for spraying, the paint can 11 can be stored with paint inside the can with plugs 30 and 31 in the fluid tube opening 13 and vent hole 35 reducing or stopping solvents from evaporating.

Figure 5:
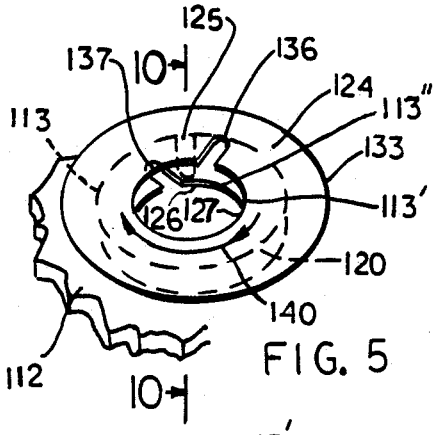
FIG. 5 is an isometric view of another embodiment of the paint wiper.

In the embodiment of the invention shown in FIG. 5 an enlarged view of another embodiment of the wiper assembly is shown. Wiper 124 may be made of resilient material like rubber, neoprene or suitable thermo plastic. Wiper assembly 124 has a cylindrical body 120 that is received in the opening 113 of the lid 112. The cylindrical body 120 has an integrally attached outwardly directed upper wiper flange 127 that overlies the lid 112 around the opening 113. Upper wiper flange 127 extends inwardly from wiper assembly 124 and slides on the tube. Opening 113' is formed in upper wiper flange 127. Lower wiper flange 126 is integrally fixed to the lower end of the cylindrical body 120. Divider 125 is fixed to the upper wiper flange 127 and to the lower wiper flange 126 providing a space between them. Divider 125 directs air from upper notch 136 to lower notch 137. Upper notch 136 is formed on the inner periphery of the upper wiper flange 127 to allow air to return into the can to replace paint that is removed through a tube like tube 15. A lower hole 113" is formed in lower wiper flange 126. Lower notch 137 is formed in the lower wiper flange 126. Lower notch 137 communicates with the can to allow air to enter and follow arrow 140 to lower notch 137, and to return paint that has been wiped from the tube 15 by the upper wiper flange 127.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination a paint receptacle [10] comprising a can [11], a lid [12] adapted to have a removable spray gun [14] having a paint tube supported thereon and a wiper assembly [124] to wipe paint from the paint tube, means supporting said lid [12] on said can [11], said lid [12] having a fluid tube opening [13], a wiper assembly [124] in said fluid tube opening, said wiper assembly [124] comprising a first flange [126] and a second flange [127] of resilient, flexible material [33], each said flange [126,127] having a first surface and a second surface, a cylindrical body [120] between said first flange [126] and said second flange [127] fixed to said flanges, [126,127], a first opening [113'] through said first flange [126] and a second opening [113"] through said second flange [127], said openings [113',113"] through said flanges being smaller than said opening [13] through said lid [12], said first opening [113'] through said first flange [126] [124] and said second opening [113"] through said second flange [127] being adapted to receive a fluid tube [15] on said spray gun [14], said flanges [126,127] extending inwardly from said cylindrical body [120], said flanges [126,127] extending outward from said cylindrical body [120] and overlying said lid [12] adjacent said fluid tube opening [113], said openings [113,113″] through said wiper assembly [124] each being defined by a cylindrical surface extending from said first surface of said particular flange to the said second surface thereof, said first opening [113′] and said second opening [113″] through said wiper assembly [124] being of lesser diameter than said fluid tube [15] whereby said wiper assembly [124] is distorted and wipes paint from said fluid tube [15] and returns said paint to said can [11] through said second opening [113″], said second flange [127] and said first wiper flange [126] each having a notch [136,137] formed therein spaced from said cylindrical body [120] for venting air from said can [11], said notches [136,137] each terminating in spaced relation to said cylindrical body [120] and circumferentially spaced from one another.

2. The receptacle [10] recited in claim 1 wherein said can [11] has a generally cylindrical body terminating in an open top end, an outwardly and downwardly extending first flange part [21] attached to said can [11] and extending entirely around the upper part of the can, extending outwardly and downwardly therefrom at an acute angle to the horizontal, said lid [12] having a downwardly and inwardly extending second flange part [22] terminating in an annular third flange part [23] extending inwardly at a greater angle to the vertical than said first flange part [21], said first flange part [21] having an outer edge engaging said second flange part [22] forming a seal.

3. The receptacle recited in claim 1 wherein a tube part [28] is attached to said spray gun [14] and attached to said tube [15] in said wiper assembly [24], said spray gun [14] can be hand held during painting use.

4. The receptacle recited in claim 1 wherein a leaf spring bracket [19] is clamped to said spray gun [14], said leaf spring bracket [19] being adapted to engage means on said receptacle [10] to clamp said spray gun [14] to said can [11].

5. The receptacle recited in claim 1 wherein a divider ]125] is integrally attached to said upper wiper flange [127] and said lower wiper flange [126].

6. The combination recited in claim 1 wherein said can lid has a vent opening [35] therein.

* * * * *